US005687423A

United States Patent [19]

Ross

[11] Patent Number: 5,687,423

[45] Date of Patent: Nov. 18, 1997

[54] VENTILATED, FLEXIBLE JACKET HAVING A MEANS FOR INTERCONNECTING THE CAPE AND BODY PORTIONS

[76] Inventor: Stanley M. Ross, 11059-130 A Street, Surrey, British Columbia, Canada, V3T 3P1

[21] Appl. No.: 299,300

[22] Filed: Sep. 1, 1994

[51] Int. Cl.[6] ..... A41D 1/02; A41D 3/00

[52] U.S. Cl. ..... 2/93; 2/70

[58] Field of Search ..... 2/88, 93, 97, 272, 2/69, 70, 71, 72; 450/37

[56] References Cited

U.S. PATENT DOCUMENTS

| | | | |
|---|---|---|---|
| 367,921 | 8/1887 | Norton | 2/88 X |
| 423,346 | 3/1890 | Sands | 2/88 |
| 592,149 | 10/1897 | Listman | 2/70 |
| 884,479 | 4/1908 | Galland | 2/70 |
| 1,740,614 | 12/1929 | Marquist | 2/88 X |
| 1,915,044 | 6/1933 | Anderson | 2/69 |
| 2,123,969 | 7/1938 | Rosenblatt | 2/70 X |
| 2,361,381 | 10/1944 | Callahan et al. | 2/93 |
| 2,440,466 | 4/1948 | Freedman | 450/37 X |
| 2,458,004 | 1/1949 | Kerr | 2/93 |
| 2,542,300 | 2/1951 | Bagnato | 2/93 |
| 3,106,717 | 10/1963 | Cuvin | 2/70 |
| 3,921,224 | 11/1975 | Ingram, III | 2/93 |
| 4,408,356 | 10/1983 | Abrams | 2/87 |
| 4,554,682 | 11/1985 | Hillquist | 2/70 |
| 4,715,068 | 12/1987 | Jacobson | 2/272 |
| 5,201,075 | 4/1993 | Svetich | 2/93 X |

*Primary Examiner*—C. D. Crowder
*Assistant Examiner*—Shirra L. Jenkins

[57] ABSTRACT

A jacket or coat having a cape with sleeves with a portion extending down over a user's chest. A body portion covers the trunk and a portion of the chest. An attachment element is connected between the body portion and the cape.

8 Claims, 7 Drawing Sheets

VENTILATED, FLEXIBLE JACKET HAVING A MEANS FOR INTERCONNECTING THE CAPE AND BODY PORTIONS

FIELD

The present invention relates to a jacket or coat designed to permit freedom of movement and improved ventilation.

BACKGROUND

Conventional jackets and coats are made with the seam running under the arm joining the sleeve to the body section being located well below the pivotal Point of the shoulder to arm joint. This means that when the arm is raised it tends to pull up the seam and attached body section in the region below the arm. The resistance of the seam and body portion tends to inhibit the feeling of freedom of the wearer. For example golfers experience an effect on their swing due to such resistance.

A second source of resistance occurs when a user twists his shoulders and upper body. The upper portion of the jacket tends to follow the shoulders, whereas the lower portion tends to remain with the trunk of the body. This twisting of the jacket offers resistance to such motion as well.

A second problem with conventional jackets is that they generally offer no adequate means for ventilation other than through the jacket material itself. Some known jacket designs have holes under the arms and under flaps at the back in what is otherwise air impermeable material. In designs in which there are holes in the material under the arms, the weight of the arms tends to block the holes while in the case where there are holes in the material under the flaps at the rear, the relatively heavy material combined with the minimal area of the holes minimizes air flow through the holes.

U.S. Pat. No. 4,408,356 issued to Abrams discloses a rain jacket in which the body portion is made up of several wide parallel horizontal sections of moisture-impermeable flexible sheet material disposed in shingled relationship and with each section sewn to a liner. Aside from its unconventional appearance, the expense of making such a jacket is considerably more than the fabrication costs for a conventional jacket. In addition, while offering some improvement in movement facility for a user, there is still considerable restriction to lifting the arms and to twisting due to its design.

Accordingly, it is an object of the invention to provide a jacket or coat offering improved freedom of movement. It is a further object of the invention to provide a jacket or coat having improved ventilation.

SUMMARY OF THE INVENTION

According to the invention there is provided a jacket or coat having a cape with sleeves with a portion extending down over a user's chest. A body portion covers the trunk and a portion of the chest. An attachment means is connected between the body portion and the cape.

Preferably, the attachment means is air permeable and is attached near the top of the body portion and the top of the cape. By forming the jacket or coat in two separate units, namely, the cape and the body portion, with the region between the two being air permeable, a large area for air flow is provided which gives improved ventilation over that of conventional jackets or coats.

Advantageously, a movable connection between the cape and the body portion at a rear of the jacket permits relative movement between the cape and the body portion. The movable connection may be an elongated strip fastened to either the cape near a bottom thereof or to the body portion in a horizontal disposition and a guide which constrains the strip to lateral sliding movement attached to the other of the cape or the body portion. The latter sliding action of the strip within the guide permits lateral movement of the cape relative to the body portion proximate a bottom of the cape with little or no resistance. At the same time the strip and guide hold the cape close to the body portion and thereby prevent curling up of the cape as is common with conventional jackets having a cape or flap.

BRIEF DESCRIPTION OF THE DRAWINGS

The novel features believed characteristic of the invention are set forth in the appended claims. The invention itself, as well as other features and advantages thereof, will be best understood by reference to the description which follows read in conjunction with the accompanying drawings, wherein:

DETAILED DESCRIPTION WITH REFERENCE TO THE DRAWINGS

Figure 1:
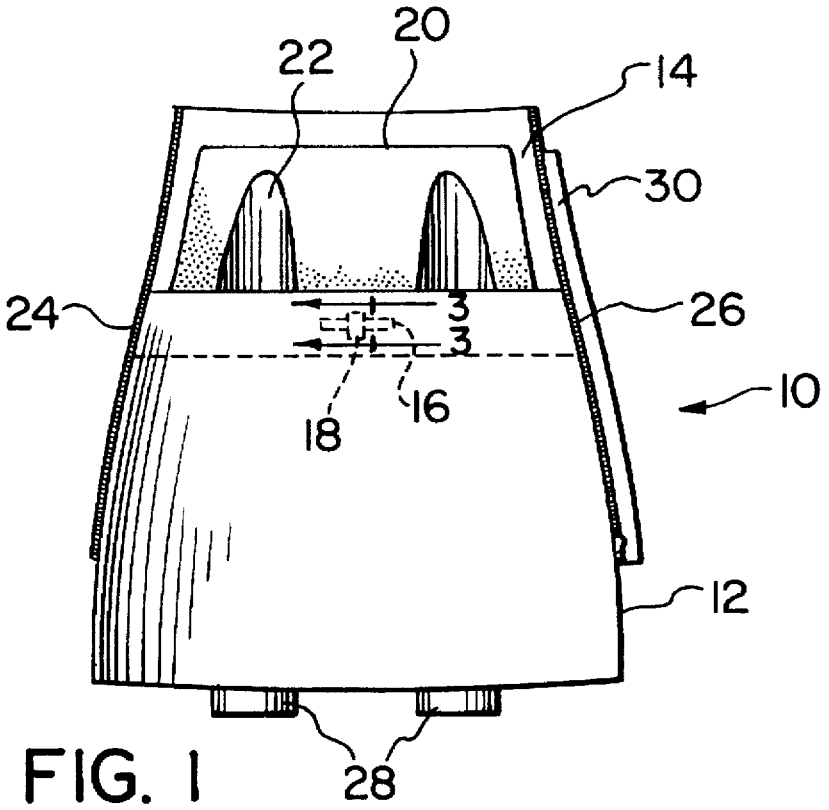
FIG. 1 is a front elevation view of the jacket with the jacket open.
Figure 2:
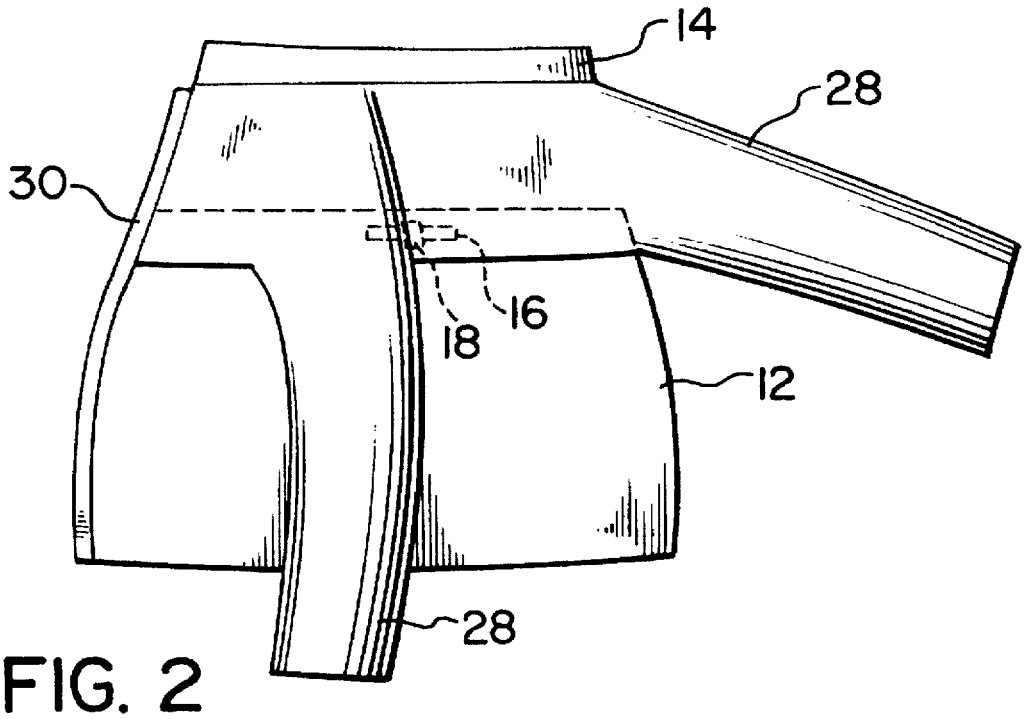
FIG. 2 is a rear elevation view of the jacket with the jacket open.

Referring to FIGS. 1 and 2 there is shown a front elevation view of the jacket 10 consisting of a rectangular body portion 12, a cape 14 and a web 20. The web 20 is connected to a top of the body portion 12, to a top of the cape 14 and along the neckline of the cape 14 as seen by the dotted lines 38 of FIGS. 7 and 8. The web 20 has openings 22 to permit the arms of a user to pass into sleeves 28. The web 20 is also attached along its sides to cape 14. A zipper 24 and 26 are attached along the front with one side having a zipper flap 30.

Shown in dotted outline is an elongated strip 16 attached at its opposite ends in a horizontal disposition to the body portion 12 and guide 18, which loosely loops around strip 16 attached to the inside of the cape 14. The latter strip 16 and guide 18 serve to hold the rear of the cape 14 juxtaposed to the overlapping region of the body portion 12 and prevents the tendency of that portion of the cape to curl up.

Figure 3:
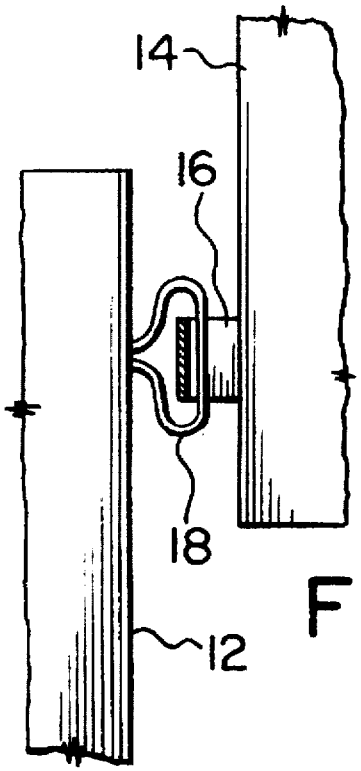
FIG. 3 is a partial sectional view of the sliding connection between the cape and the body portion.

Referring to FIG. 3 there is shown in partial cross-section the sliding connection between the cape 14 and the body portion 12 at the back. The strip 16 is an elongated strip of material attached at either end to the inside of the cape 14.

Attached to the back of the body portion is a guide 18 of material which surrounds the strip 16. Twisting movement of a user causes the guide 18 to move relative to the strip 16 so as to avoid the resistance that would be offered in twisting the cloth.

By utilizing a light flexible web 20, with no direct interconnection between the sleeves 28 and the body portion 12, raising of a user's arms does not tend to raise the body portion 12 of the jacket 10.

Figure 4:
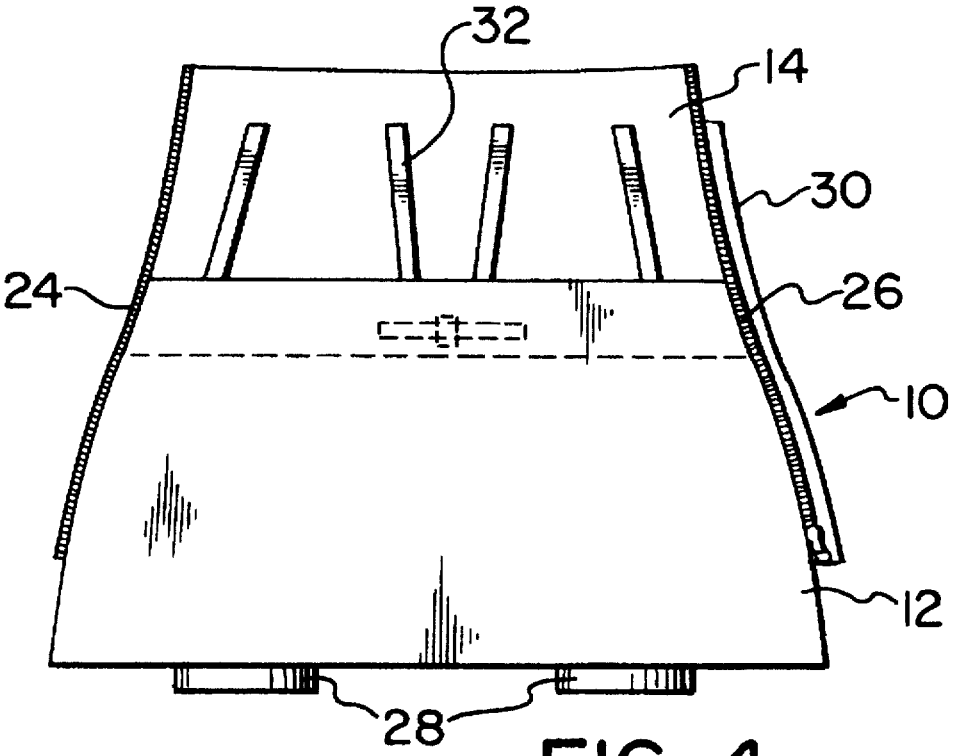
FIG. 4 is a front elevation view of an alternative embodiment of the jacket having straps to interconnect the cape and body portions.

As seen in FIG. 4 there is shown an interconnection between the cape and the body portion in which web 20 is replaced by a series of vertical straps 32. Whether web 20 or straps 32 are used, the jacket 10 does permit air to enter between the body portion 12 and the cape 14 and to escape either up through the neck region or out of the bottom of the cape.

Figure 5:
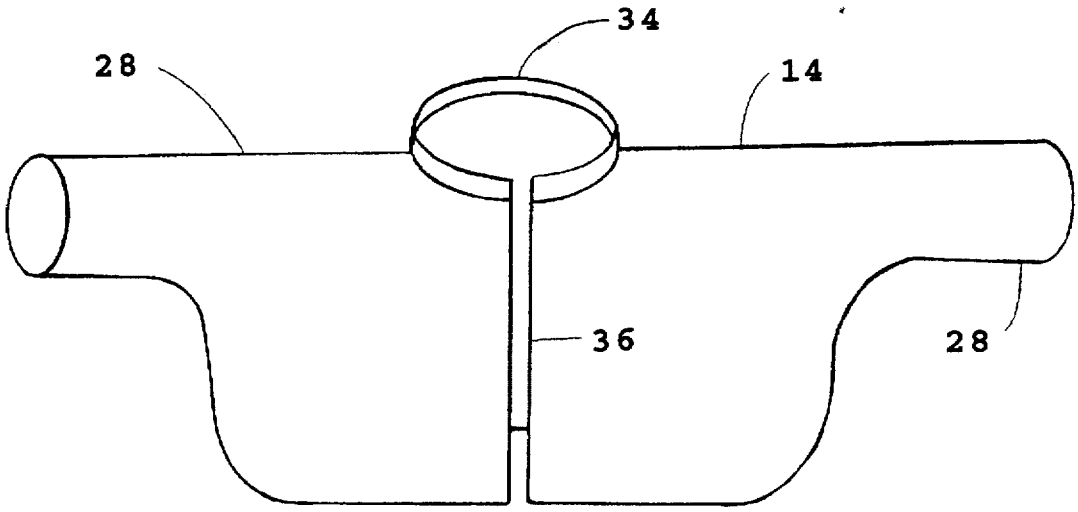
FIG. 5 is a perspective view of the cape alone.
Figure 6:
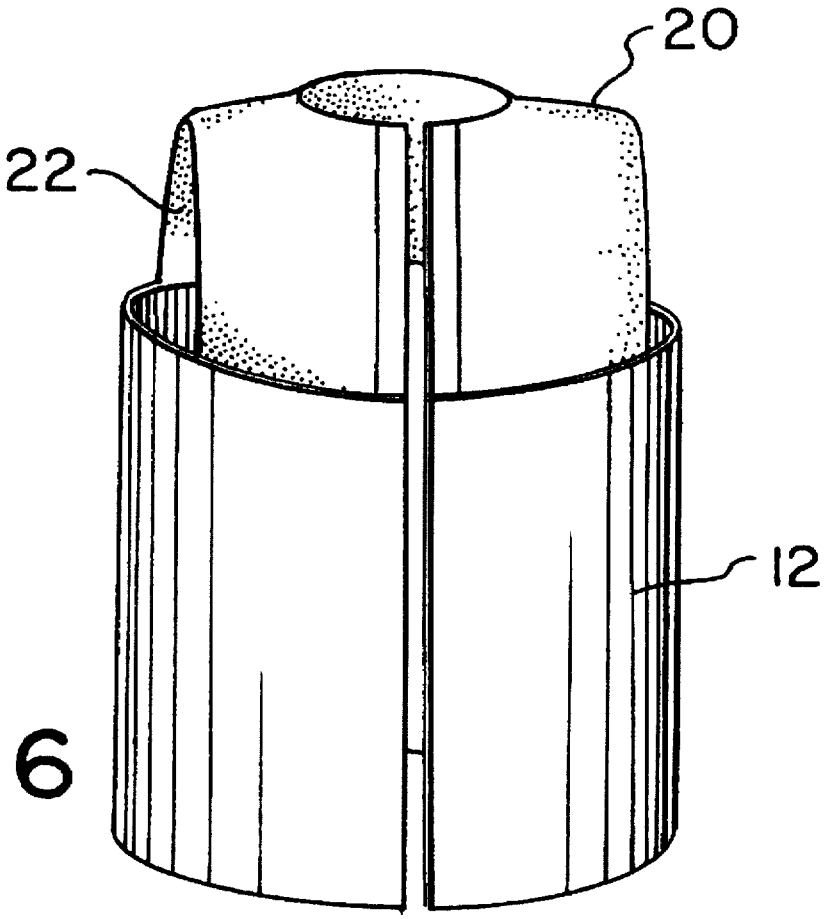
FIG. 6 is a perspective view of the web and body portion.
Figure 7:
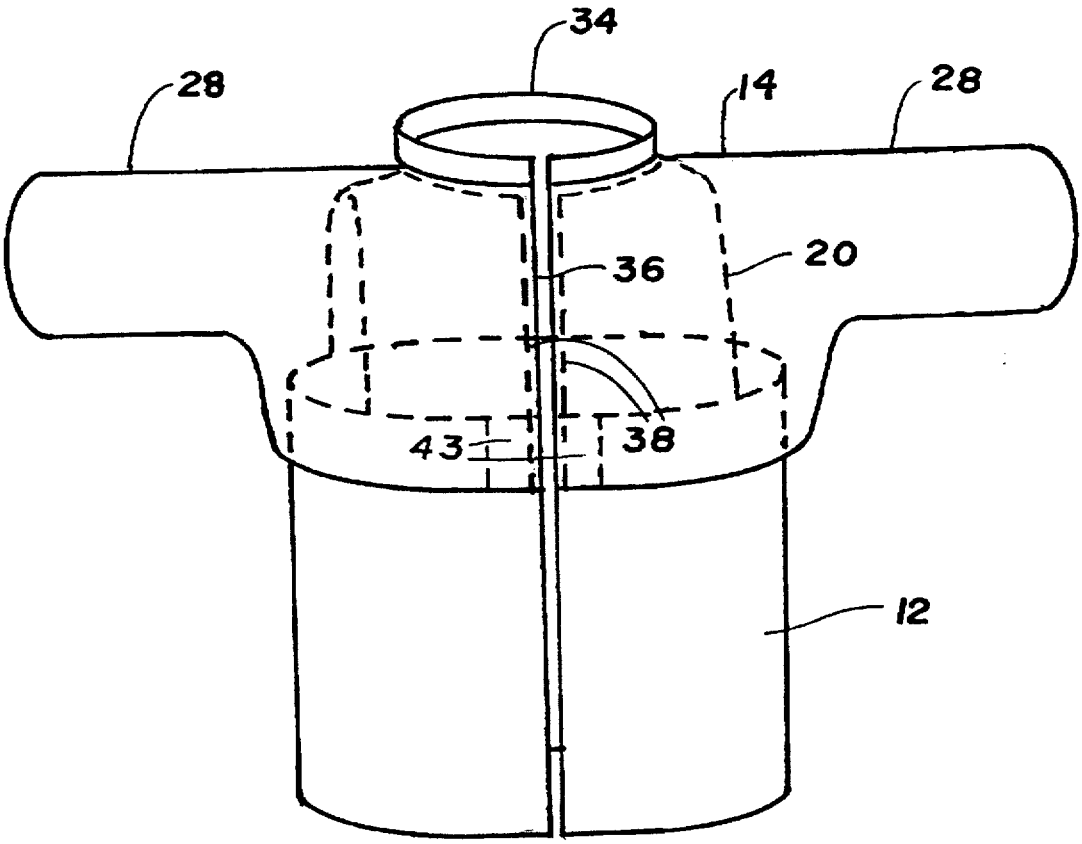
FIG. 7 is a perspective view of the web, cape, and body portion.
Figure 8:
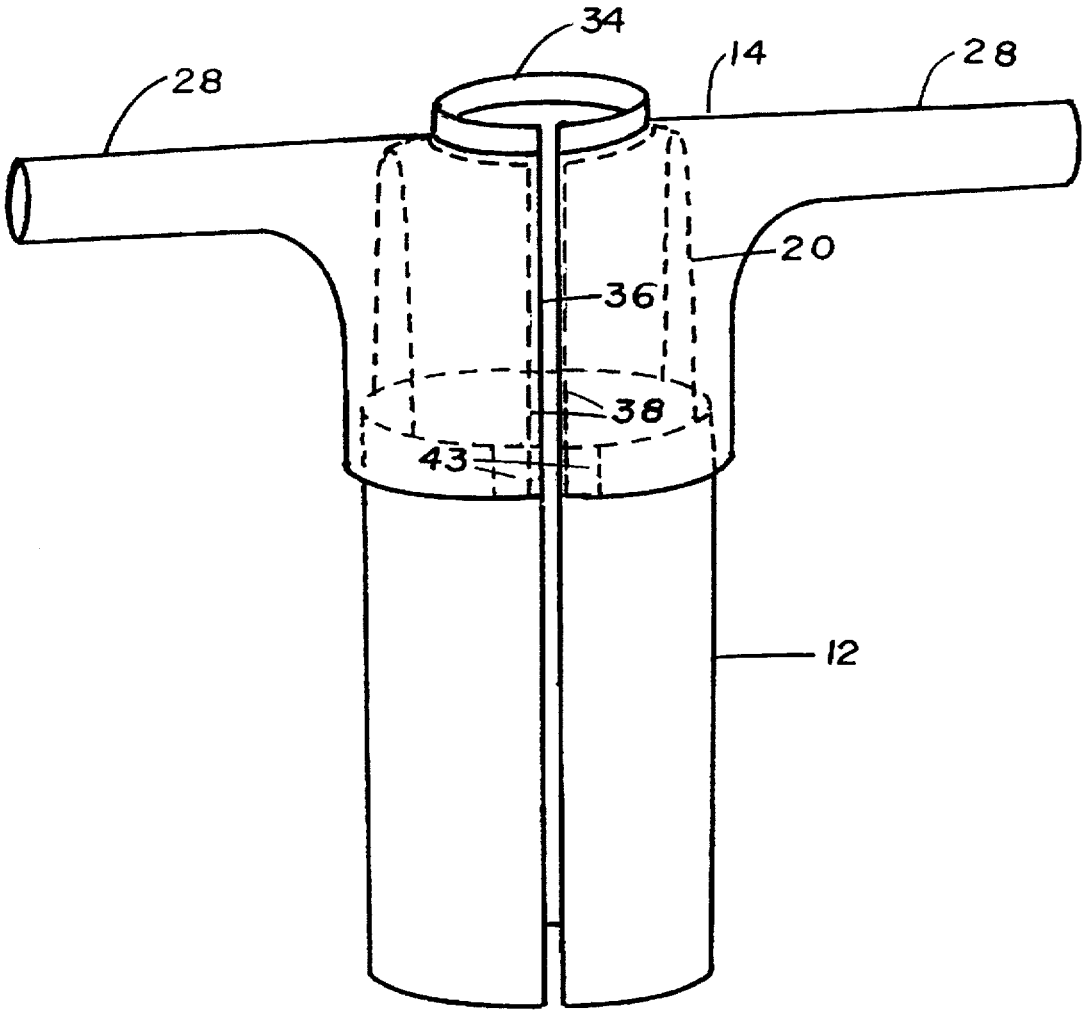
FIG. 8 is a perspective view of a full length coat according to a preferred embodiment of the invention.

Referring to FIG. 5 there is shown the cape 14 which has a collar 34, a front opening 36 and a pair of sleeves 28. FIG. 6 shows the web 20 and body portion 12 attached with sleeve openings 22. FIG. 7 shows the cape 14, web 20 and body portion 12 all attached. In both FIGS. 7 and 8 the dotted lines 38 show the region in which the web 20 is attached to the cape 14, namely, around the neck and down alongside the front opening 36. As seen in FIG. 8, in the region of overlap between the cape 14 and the body portion 12, the latter two are fastened together in areas 43 along either side of the opening 36. Since the cape 14 is attached to the web 20 only around the neck and down the opening 36, aside from the sliding connection to the body portion 12, twisting, stretching and extension movement of the body of a user, causes the cape 14 to move sideways around its periphery relative to the body portion 12 offering little resistance to such movement. Since there is no attachment below the arms between the cape bottom and the body portion 12, as a user's arms are raised there is much less of a tendency for the sleeves 28 to be impeded by the body portion 12. Having a light flexible web 20 allows twisting of the web with little resistance.

Figure 9:
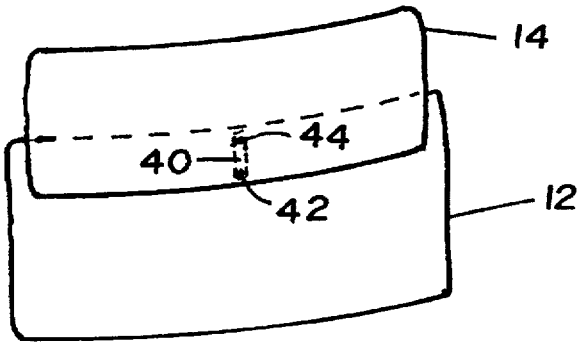
FIG. 9 is a partial perspective view of a pendulum connection between the cape and the body portion.

FIG. 9 shows an alternative pendulum type of connection between cape 14 and body portion 12 in which a vertically disposed strip 40 is rotationally attached to the body portion 12 by connector 42 and to the cape 14 by connector 44. Lateral movement of the cape 14 relative to the body portion 12 causes the strip 40 to tilt due to the rotational movements of connectors 42 and 44.

Figure 10:
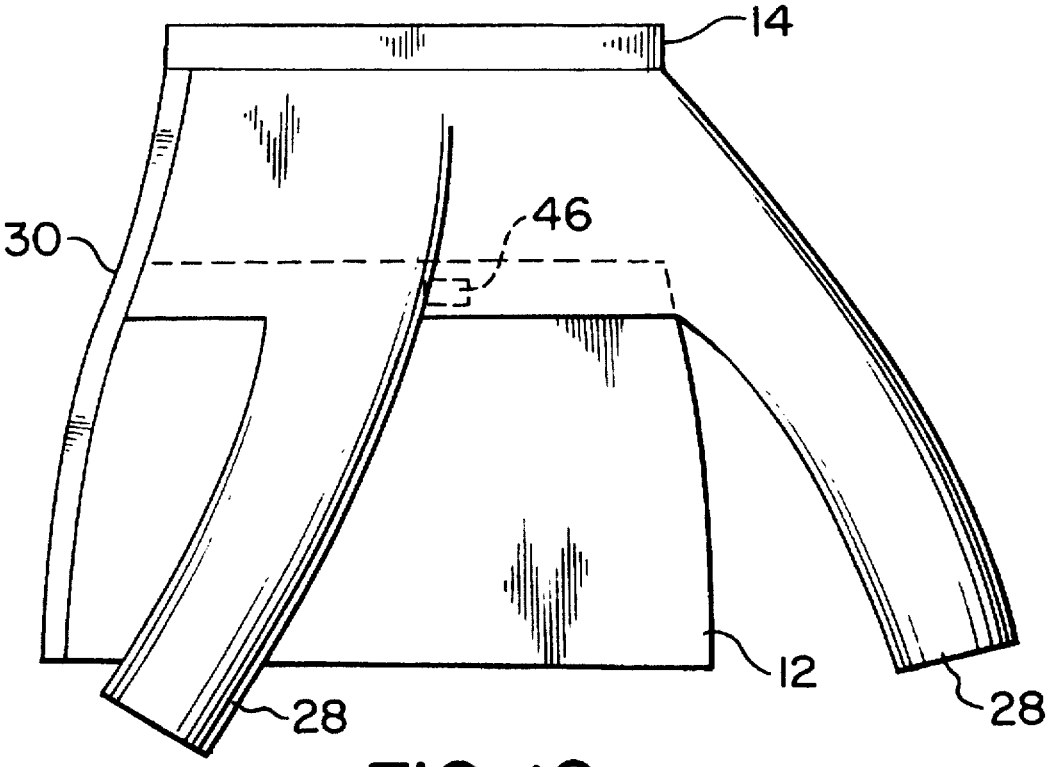
FIG. 10 is a perspective view of the rear of the jacket showing the region of attachment between the cape and the body portion.

A less preferred but still acceptable alternative structure is shown in FIG. 10 in which the cape 14 is sewn to the body portion 12 in the center of the back at region 46. While restricting somewhat twisting movement, upward movement of the arms is almost unaffected and ventilation is almost the same.

Obviously various material can be used for the jacket 10 or coat such water impermeable materials where the invention is to be used with rain gear or materials such as cotton where moisture protection is not required.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modification or embodiments as fall within the true scope of the invention.

I claim:

1. A jacket or coat, comprising:

(a) a body portion for enclosing the trunk and only a lower portion of the chest of a user;

(b) a cape having sleeves for enclosing the shoulders and arms and a portion of the chest of a user; and (c) means for interconnecting the body portion and a top of the cape which permits relative movement of the two and air flow through substantially the whole upper chest and back region of a user.

2. A jacket or coat according to claim 1, wherein said interconnecting means is air permeable.

3. A jacket or coat according to claim 1, wherein said interconnecting means is a flexible material.

4. A jacket or coat according to claim 1, wherein said cape, said interconnecting means and said body portion are open along a front thereof and said interconnecting means said cape and said body portion are fastened together along the front and around a neckline thereof.

5. A jacket or coat according to claim 1, further including a movable connection between said cape and said body portion at a rear thereof proximate a bottom of said cape which permits lateral relative movement between said cape and said body portion.

6. A jacket or coat according to claim 5, wherein said movable connection includes an elongated strip fastened at both ends in a horizontal disposition to one of said body portion and said cape and a guide constraining said elongated strip to sliding movement through said guide and said guide being fastened to another of said body portion and said cape.

7. A jacket or coat according to claim 1, wherein said interconnecting means is a plurality of spaced apart strips interconnecting a top of said cape with a top of said body portion.

8. A jacket or coat according to claim 1, wherein said interconnecting means is a flexible web material which covers the upper chest and back and extends from the upper portion of the body portion and around the shoulders.

* * * * *